US011067311B2

(12) United States Patent
Park et al.

(10) Patent No.: US 11,067,311 B2
(45) Date of Patent: Jul. 20, 2021

(54) FIELD CONVERSION ELECTRIC WATER HEATER

(71) Applicant: Rheem Manufacturing Company, Atlanta, GA (US)

(72) Inventors: Matthew S. Park, Auburn, AL (US); Timothy D. Scott, Tallassee, AL (US); William Jason Hall, Prattville, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 324 days.

(21) Appl. No.: 16/034,085

(22) Filed: Jul. 12, 2018

(65) Prior Publication Data

US 2020/0018521 A1 Jan. 16, 2020

(51) Int. Cl.

| | |
|---|---|
| ***H05B 1/02*** | (2006.01) |
| ***F24H 9/20*** | (2006.01) |
| ***F24H 9/18*** | (2006.01) |
| ***F24H 1/20*** | (2006.01) |

(52) U.S. Cl.

CPC ..... *F24H 9/2021* (2013.01); *F24H 1/202* (2013.01); *F24H 9/1818* (2013.01)

(58) Field of Classification Search

CPC ..... F24H 9/2021; F24H 1/202; F24H 9/1818; H05B 1/02; H05B 1/0244; H05B 1/0297; H05B 3/0052

USPC ..... 219/494, 483, 486, 497

See application file for complete search history.

(56) References Cited

U.S. PATENT DOCUMENTS

| | | | | |
|---|---|---|---|---|
| 6,271,505 | B1 * | 8/2001 | Henderson | F24H 9/2021 219/483 |
| 10,670,302 | B2 * | 6/2020 | Hazzard | F23N 5/242 |
| 2016/0195284 | A1 * | 7/2016 | Chaudhry | F24H 1/202 392/449 |

* cited by examiner

*Primary Examiner* — Mark H Paschall

(74) *Attorney, Agent, or Firm* — Troutman Pepper Hamilton Sanders LLP

(57) ABSTRACT

An electric water heater has upper and lower electric resistance type heating elements respectively controlled by a single pole, double throw upper thermostat and a single pole, single throw lower thermostat. The upper and lower thermostats are operatively interconnected by a wiring harness having outer conductor end portions that are connected to a terminal block portion of an external junction box to provide the water heater with a variety of heating element operating modes without having to replace either of the thermostats, vary the wiring harness interconnections therebetween, or vary the connection between the outer conductor end portions and the terminal block. The water heater may thus be advantageously manufactured in a single variant that may be easily and quickly modified in the field to selectively alter the heating element control mode of the water heater.

18 Claims, 6 Drawing Sheets

FIELD CONVERSION ELECTRIC WATER HEATER

TECHNICAL FIELD

Embodiments described herein relate to a terminal block for a dual element water heater.

BACKGROUND OF THE INVENTION

The present invention generally relates to electric heating apparatus and, in a preferred embodiment thereof, more particularly relates to a specially designed dual element electric water heater which is easily field convertible among various heating element control modes without the previous necessity of changing either of the heating element control thermostats or altering the wiring interconnections therebetween.

In a common construction thereof a vertically oriented dual element electric water heater has spaced apart upper and lower resistance type electric heating elements which horizontally extend into the interior of the water storage tank portion of the heater. The operation of these upper and lower heating elements is controlled by upper and lower electric thermostats which are respectively associated with the upper and lower heating elements.

Various modes of operating the upper and lower heating elements, with either single or three phase electric power supply to the water heater, are typically available. Representatively, these heating element operational modes include (1) dual independent branch circuit installation; (2) single phase simultaneous element operation, in which the two heating elements are controlled independently by their associated thermostats allowing upper, lower, or both elements to operate; (3) single phase non-simultaneous element operation, in which the upper thermostat turns off the lower thermostat when the upper element turns on allowing either upper or lower element to operate but not both simultaneously; (4) single phase non-simultaneous element operation with 4 wire outlet operation; (5) single phase non-simultaneous element operation with 3 wire outlet operation; (6) three phase simultaneous element operation; and (7) three phase non-simultaneous element operation. The two heating element-controlling thermostats are typically disposed in openings formed in the jacket insulation structure of the water heater that surrounds its storage tank portion. The electrical wiring that operatively interconnects the thermostats is, for the most part, disposed between the tank and the insulation structure.

In the past, in order to provide these seven representative element control modes seven separate embodiments or "variants" of the water heater needed to be built, with each water heater variant having different thermostat wiring configurations and/or combinations of thermostat types. The need to build separate variants to provide all of the representative types of heating element control listed above carries with it several problems, limitations and disadvantages.

For example, the construction of the water heater is made more complex since, in essence, it needs to be constructed in seven different ways—each having a different thermostat type combination and/or thermostat wiring interconnection configuration. Additionally, and quite importantly, once the water heater is constructed to provide a predetermined element control mode, it is not practical or economical to alter this selected control mode. This is due to the fact that to alter the originally built-in element control mode, changes must be made to the thermostat wiring and/or the types of thermostats used must be altered. Because the thermostat interconnection wiring is disposed between the jacket insulation structure and the water heater storage tank portion such wiring is, as a practical matter, inaccessible for such conversion.

Accordingly, if a dual element water heater constructed in this conventional manner does not provide the desired heating element control mode, it has to be replaced with another manufactured variant of the water heater that has the desired heating element control mode incorporated therein during its original manufacture. In view of this it can be readily seen that a need exists for a dual element electric water heater which eliminates or at least substantially reduces the above-mentioned problems, limitations and disadvantages typically associated with conventionally constructed dual element electric water heaters.

U.S. Pat. No. 6,271,505 describes a dual element water heater constructed with upper and lower thermostats operatively interconnected by a wiring harness having outer wire end portions that may be connected in various orientations to a terminal block portion of an external junction box to provide the water heater with a variety of heating element operating modes without having to replace either of the thermostats or the interconnections between the thermostats. Connecting outer wire end portions in varying orientations to the terminal block requires a need for capping or taping of wire end portions not used, and may complicate the field conversion process to change the control mode of the water heater. It is to this need that the present invention is directed.

SUMMARY OF THE INVENTION

In carrying out principles of the present invention, in accordance with a preferred embodiment thereof, a liquid heating apparatus having first and second spaced apart liquid heating elements is provided. The apparatus is representatively in the form of an electric water heater having vertically spaced apart upper and lower electric resistance type heating elements that horizontally extend into the interior of a water storage tank portion of the water heater. First and second electric thermostats are respectively and controllingly associated with the upper and lower heating elements, and wiring, representatively in the form of a wiring harness, is operatively connected to the first and second thermostats and has conductor end portions variably connectable to a source of electrical power through a junction box having a terminal block portion with line side terminals to which electrical power supply conductors may be variably connected, and water heater side terminals to which the aforementioned wiring harness conductor end portions are connected in a fixed arrangement.

The first electric thermostat, which controls the upper heating element, is of a single pole double throw configuration, and the second electric thermostat, which controls the lower heating element, is of a single pole single throw configuration. The wiring harness is connected to the first and second thermostats, and to the terminal block, in a manner such that, without replacing either of the first and second thermostats and/or altering the wiring connections to either thermostat or the terminal block, a plurality of heating element control modes may be provided simply by changing the electrical power supply connections to the terminal block or by connecting either line side terminals or water heater side terminals using jumpers or other similar connectors.

Representatively, these element control modes include (1) dual independent branch circuit installation, (2) single phase simultaneous dual element control mode, (3) a single phase non-simultaneous dual element control mode, (4) a single phase non-simultaneous dual element control mode with four wire outlet operation, (5) a single phase non-simultaneous dual element control mode with three wire outlet operation, (6) a three phase simultaneous dual element control mode, and (7) a three phase non-simultaneous dual element control mode.

In an illustrated preferred embodiment of the electric water heater, the first electric thermostat has an ECO portion with first, second, third and fourth power supply terminals, and a switch portion with a switch power terminal and first and second switch contacts. The second electric thermostat has an ECO portion with first, second, third and fourth power supply terminals, a switch power terminal and a switch contact.

Additionally, the wiring harness includes (1) a first conductor interconnected between the third power supply terminal of said first thermostat ECO portion and the switch power terminal of the first thermostat switch portion, (2) a second conductor interconnected between the first switch contact of the first thermostat switch portion and the upper heating element, (3) a third conductor interconnected between the fourth power supply terminal of the first thermostat ECO portion and the upper heating element, (4) a fourth conductor interconnected between the third power supply terminal of the second thermostat ECO portion and the switch power terminal of the second thermostat, (5) a fifth conductor interconnected between the switch contact of the second thermostat switch portion and the lower heating element, (6) a sixth conductor interconnected between the fourth power supply terminal of the second thermostat ECO portion and said lower heating element, and (7) a series of electrical conductors each having a first end portion operatively connected to one of the first and second thermostats, and a second end connected to the water heater side of the terminal block.

The series of wiring harness conductors connected to the water heater side of the terminal block preferably include (1) a first conductor connected at one end to the first power supply terminal of the second thermostat ECO portion and connected at the other end to the water heater side of the terminal block, (2) a second conductor connected at one end to the first power supply terminal of the first thermostat ECO portion and connected at the other end to the water heater side of the terminal block, (3) a third conductor connected at one end to the second power supply terminal of the first thermostat ECO portion and connected at the other end to the water heater side of the terminal block, (4) a fourth conductor connected at one end to the second switch contact of the first thermostat switch portion and connected at the other end to the water heater side of the terminal block, and (5) a fifth conductor connected at one end to the second power supply terminal of the second thermostat ECO portion and connected at the other end to the water heater side of the terminal block.

In a preferred embodiment of the dual element electric water heater, the water heater has an external well area in which the terminal block ends of the wiring harness conductors may be disposed prior to their operative connection to the terminal block, and the junction box is removably connectable to the water heater and may be shipped loose therewith for subsequent mounting thereon and operative connection to external power supply conductors and the terminal block ends of the wiring harness conductors.

While the liquid heating apparatus of the present invention is representatively an electric water heater, it could alternatively be a variety of other types of liquid heating apparatus. Additionally, while the outer ends of the aforementioned wiring harness conductors are representatively connectable to a terminal block portion of a junction box, it will be readily appreciated by those of skill in this particular art that they could alternatively be variably connected to an electrical power source in a variety of other manners if desired.

DETAILED DESCRIPTION

Figure 1:
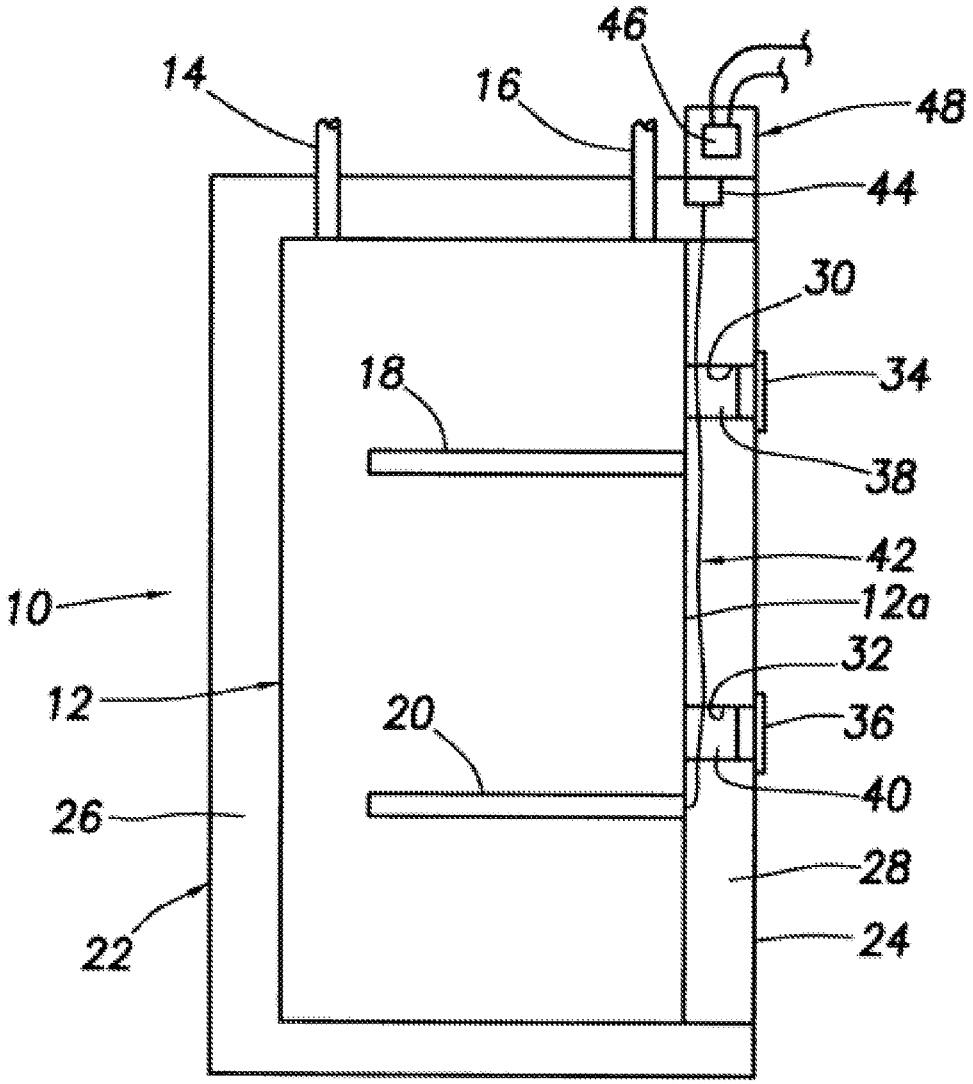
FIG. 1 is a highly schematic cross-sectional view through a field conversion dual element electric water heater embodying principles of the present invention.

Schematically illustrated in FIG. 1 is a dual element electric water heater 10 embodying principles of the present invention. Water heater 10 includes a vertically oriented cylindrical metal water storage tank 12 which has, at its top end, suitable water inlet and outlet piping connections 14 and 16. Vertically spaced apart elongated upper and lower electric resistance type water heating elements 18 and 20 longitudinally extend horizontally into the interior of the tank 12 from a vertical sidewall portion thereof. The tank 12 is surrounded by an insulation jacket structure 22 including an outer metal skin portion 24 and a foamed-in insulation material 26 interposed between the metal skin portion 24 and the tank 12.

Extending along a vertical side portion 12*a* of the tank through which the upper and lower heating elements 18 and 20 inwardly extend is an insulating structure 28, such as a bag or another type of construction, which is designed to incorporate the insulating material 26 and provides a vertically spaced pair of peripherally sealed access openings 30 and 32 extending therethrough and respectively positioned somewhat above the outer ends of the upper and lower heating elements 18 and 20. Openings 30, 32 are respectively aligned with sidewall access openings formed in the jacket metal skin portion 24 and covered by removable access plates 34 and 36. Upper and lower electric thermostats 38 and 40 are respectively received in the access openings 30 and 32 and may be accessed by removing the plates 34 and 36.

The upper and lower thermostats 38 and 40 are respectively and controllingly coupled to the upper and lower heating elements 18 and 20 and are electrically interconnected to one another by a subsequently described wiring harness 42 which is disposed between the insulation 28 and a vertical sidewall portion of the tank 12. During shipment of the water heater 10, upper end portions of various individual conductors which make up the harness 42 are placed in a top end well area 44 in the water heater 10 for subsequent operative connection to a terminal block portion 46 of a junction box 48. The term "conductor" as used in this patent application refers to electrical conductors and can include, as non-limiting examples, a wire, a lead, a cable, or a busbar. Representatively, the junction box 48 is shipped loose with the water heater and is subsequently attached to a top end portion thereof as schematically depicted in FIG. 1. In other embodiments, the well area 44 and the junction box 48 may also be attached or placed in an enclosure at the front of the water heater.

Figure 2:
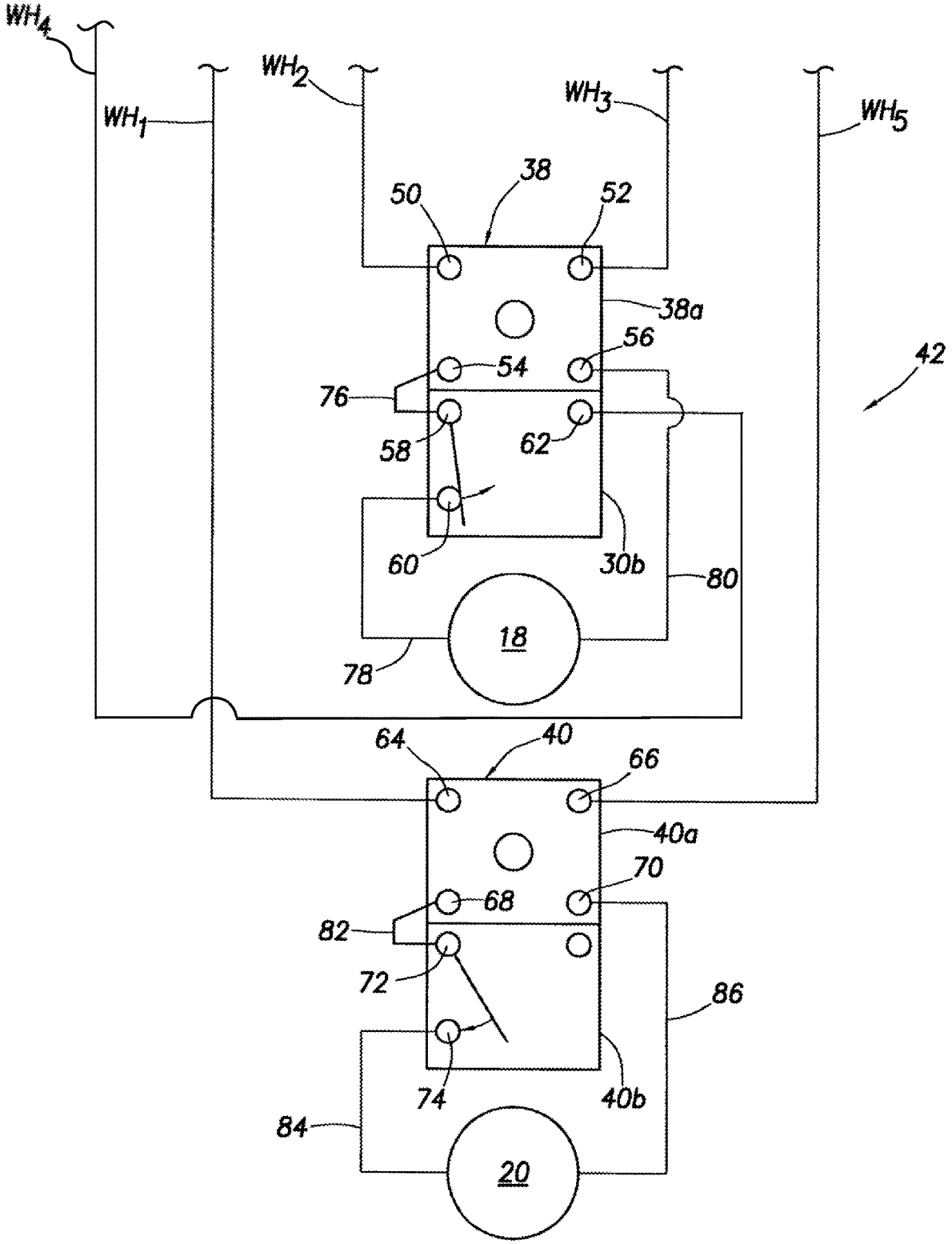
FIG. 2 is a schematic wiring diagram of a thermostat/heating element portion of the water heater.

Turning now to FIG. 2, in the illustrated preferred embodiment of the dual element electric water heater 10, the upper thermostat 38 is of a single pole double throw configuration and has an ECO (energy cut-off) high limit control portion 38*a* operatively associated with a switch portion 38*b*, and the lower thermostat 40 is of a single pole single throw configuration and has an ECO high limit control portion 40*a* operatively associated with a switch portion 40*b*.

The upper thermostat ECO portion 38*a* has power supply terminals 50, 52, 54, and 56, and the upper thermostat switch portion 38*b* has a switch power terminal 58 and switch contacts 60 and 62. The lower thermostat ECO portion 40*a* has power supply terminals 64, 66, 68, and 70, and the lower thermostat switch portion 40*b* has a switch power terminal 72 and a switch contact 74.

Wiring harness 42 includes a conductor 76 interconnected between the power supply terminal 54 and the switch power terminal 58; a conductor 78 interconnected between the switch contact 60 and the upper heating element 18; a conductor 80 interconnected between the power supply terminal 56 and the upper heating element 18; a conductor 82 interconnected between the power supply terminal 68 and the switch power terminal 72; a conductor 84 interconnected between the switch contact 74 and the lower heating element 20; and a conductor 86 interconnected between the power supply terminal 70 and the lower heating element 20.

The wiring harness 42 also includes five water heater power connection conductors $WH_1$, $WH_2$, $WH_3$, $WH_4$, and $WH_5$ which are connected to the terminal block portion 46 of the junction box 48. As subsequently described, selectively variable connections or using jumpers or other connectors in the terminal block 46 provide the upper and lower heating elements with a variety of control modes without the necessity of removing and replacing either of the thermostats 38 and 40, altering any of the wiring that interconnects the thermostats 38 and 40, or altering the wiring that interconnects the five water heater power connection conductors $WH_1$, $WH_2$, $WH_3$, $WH_4$, and $WH_5$ to the terminal block 46. The power connection conductors $WH_1$, $WH_2$, $WH_3$, $WH_4$, and $WH_5$ extend upwardly from the thermostats 38 and 40 behind the insulation structure 28 (see FIG. 1), with upper end portions of the conductors $WH_1$, $WH_2$, $WH_3$, $WH_4$, and $WH_5$ being received in the well area 44 prior to connection of such upper conductor end portions to the terminal block 46 as subsequently described herein.

As schematically depicted in FIG. 2, the lower end of conductor $WH_1$ is connected to the lower thermostat power supply terminal 64; the lower end of conductor $WH_2$ is connected to the upper thermostat power supply terminal 50; the lower end of conductor $WH_3$ is connected to the upper thermostat power supply terminal 52; the lower end of conductor $WH_4$ is connected to the upper thermostat switch contact 62; and the lower end of conductor $WH_5$ is connected to the lower thermostat power supply terminal 66.

Figure 3:
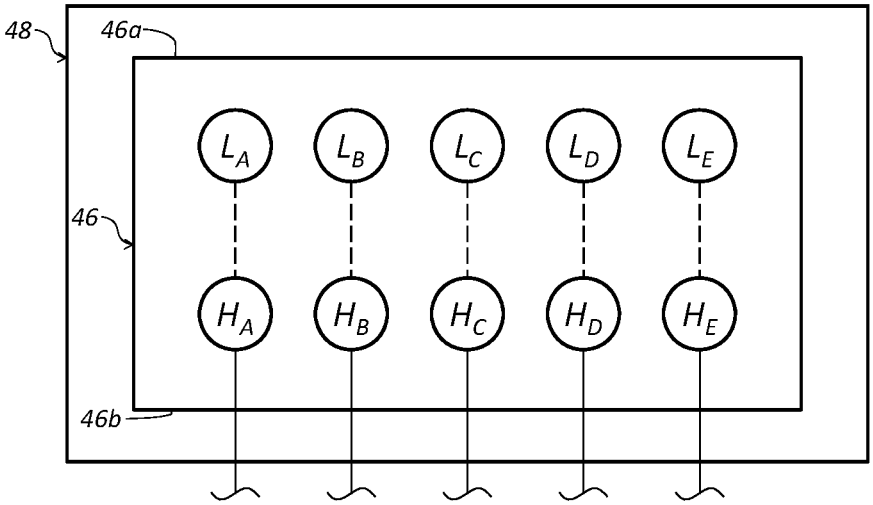
FIG. 3 is a schematic diagram of a junction box/terminal block structure operatively associated with the heating element control thermostats of the water heater.

Turning now to FIG. 3, the terminal block portion 46 of the junction box 48 has a line side 46*a* with terminals $L_A$, $L_B$, $L_C$, $L_D$, and $L_E$, and a water heater side 46*b* with terminals $H_A$, $H_B$, $H_C$, $H_D$, and $H_E$ electrically coupled to the line side terminals $L_A$, $L_B$, $L_C$, $L_D$, and $L_E$ as indicated by the dashed lines. With the junction box 48 either operatively mounted on the top end of the water heater 10 as schematically shown in FIG. 1 or attached or placed in an enclosure at the front of the water heater, the control mode of the water heater's upper and lower heating elements 18 and 20 may be selectively varied simply by adding or reconfiguring various wiring connections in the terminal block 46 as will now be described.

In a preferred embodiment, on the water heater side 46*b* of the terminal block 46 wiring harness conductor $WH_1$ is connected to terminal $H_B$, wiring harness conductor $WH_2$ is connected to terminal $H_C$, wiring harness conductor $WH_3$ is connected to terminal $H_D$, wiring harness conductor $WH_4$ is connected to terminal $H_A$, and wiring harness conductor $WH_5$ is connected to terminal $H_E$. Representatively, there are seven different dual heating element operational control modes available for the water heater 10 simply by adding wiring connections to the terminal block 46, and without changing the wiring interconnection between the thermostats 38 and 40, replacing either thermostat with another type of thermostat, or changing the wiring interconnection from the thermostats 38 and 40 to the terminal block 46. The seven heating element operational control modes, and the terminal block wiring configurations that yield them, are as follows:

Dual Independent Branch Circuit Installation Mode

Figure 4:
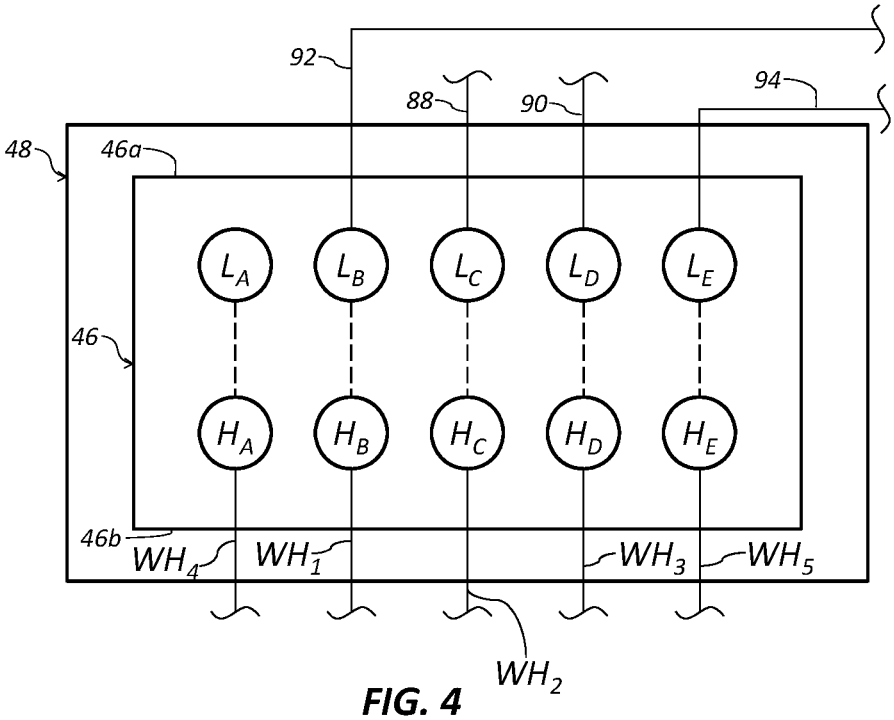
FIG. 4 is a schematic diagram of a junction box/terminal block structure operatively associated with the heating element control thermostats of the water heater for a dual independent branch circuit installation.

As schematically depicted in FIG. 4, to provide the water heater 10 with a dual independent branch circuit installation for its upper and lower electric resistance type upper and lower heating elements 18 and 20, first power supply conductors 88 and 90 are respectively connected to the terminal block line side terminals $L_C$ and $L_D$, and second power supply conductors 92 and 94 are respectively connected to the terminal block line side terminals $L_B$ and $L_E$.

Single Phase Simultaneous Dual Element Control Mode

Figure 5:
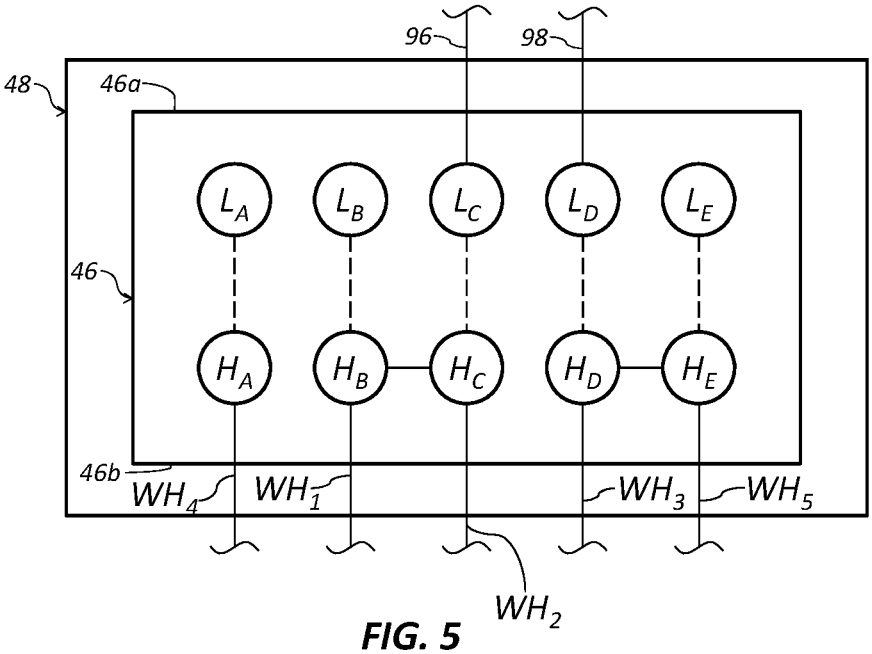
FIG. 5 is a schematic diagram of a junction box/terminal block structure operatively associated with the heating element control thermostats of the water heater for a single phase simultaneous dual element control mode.

As schematically depicted in FIG. 5, to provide the water heater 10 with a single phase, simultaneous operation of its upper and lower electric resistance type upper and lower heating elements 18 and 20, single phase power supply conductors 96 and 98 are respectively connected to the terminal block line side terminals $L_C$ and $L_D$. On the water heater side 46*b* of the terminal block 46, terminals $H_B$ and $H_C$ are connected such as with additional wiring or a jumper, and terminals $H_D$ and $H_E$ are connected such as with additional wiring or a jumper.

Single Phase Non-Simultaneous Dual Element Control Mode

Figure 6:
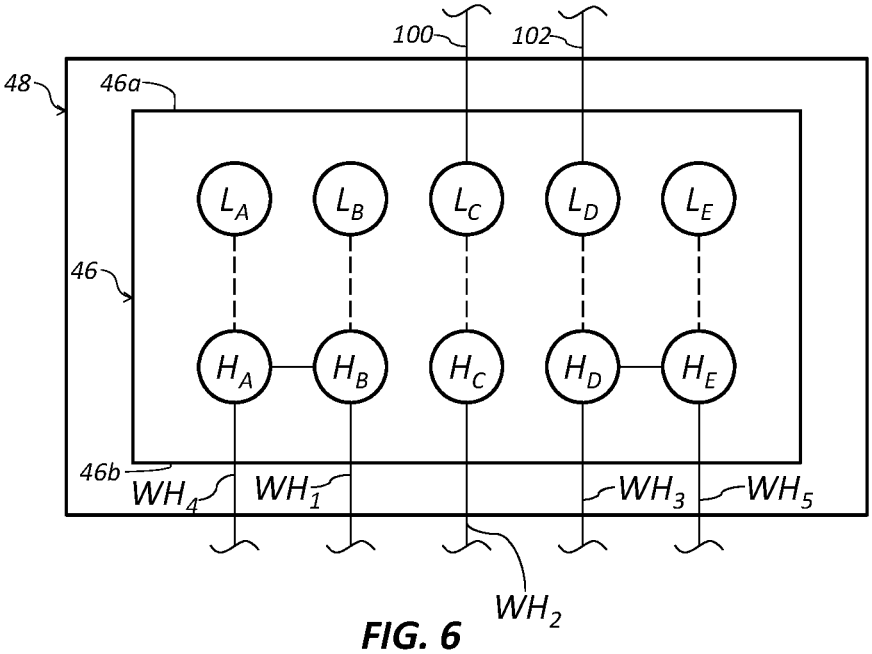
FIG. 6 is a schematic diagram of a junction box/terminal block structure operatively associated with the heating element control thermostats of the water heater for a single phase non-simultaneous dual element control mode.

As schematically depicted in FIG. 6, to provide the water heater 10 with a single phase, non-simultaneous operation of its upper and lower electric resistance type upper and lower heating elements 18 and 20, single phase power supply conductors 100 and 102 are respectively connected to the terminal block line side terminals $L_C$ and $L_D$. On the water heater side 46*b* of the terminal block 46, terminals $H_A$ and $H_B$ are connected such as with additional wiring or a jumper, and terminals $H_D$ and $H_E$ are connected such as with additional wiring or a jumper.

Figure 7:
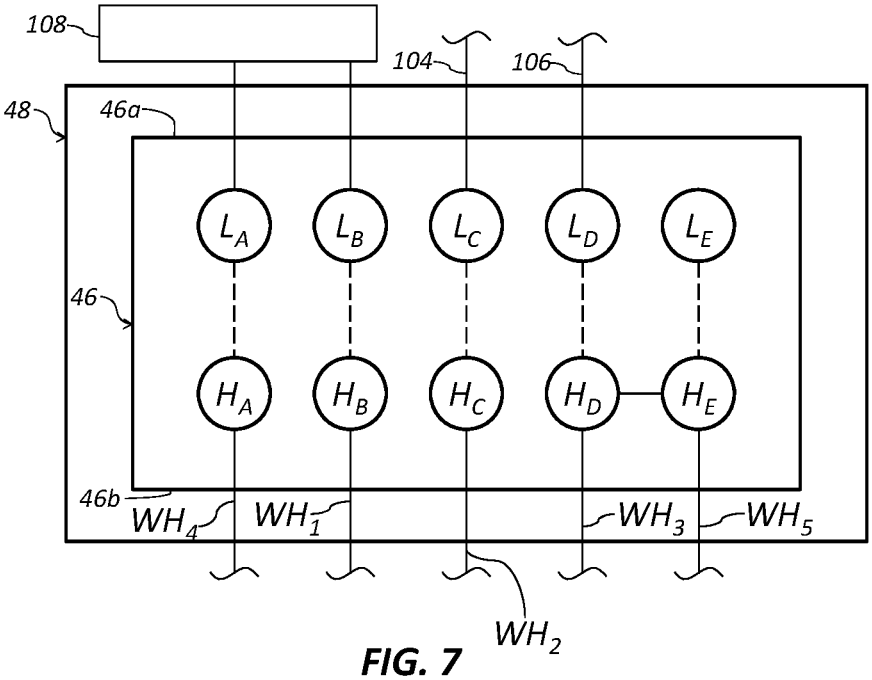
FIG. 7 is a schematic diagram of a junction box/terminal block structure operatively associated with the heating element control thermostats of the water heater for a single phase non-simultaneous dual element control mode with four wire outlet operation.

Single Phase Non-Simultaneous Dual Element Control Mode with 4 Wire Outlet Operation As schematically depicted in FIG. 7, to provide this dual element operational control mode, single phase power supply conductors 104 and 106 are respectively connected to the terminal block line side terminals $L_C$ and $L_D$. On the water heater side 46*b* of the terminal block 46, terminals $H_D$ and $H_E$ are connected such as with additional wiring or a jumper. Additionally, if off peak metering is desired, an off peak meter or timer is connected to terminals $L_A$ and $L_B$ on the line side 46*a* of the terminal block.

Figure 8:
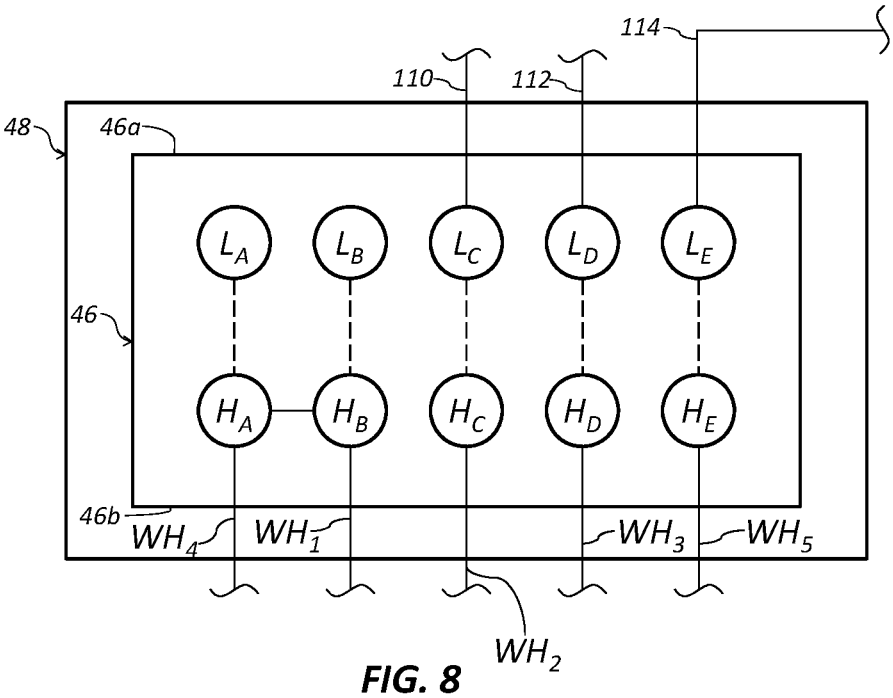
FIG. 8 is a schematic diagram of a junction box/terminal block structure operatively associated with the heating element control thermostats of the water heater for a single phase non-simultaneous dual element control mode with three wire outlet operation.

Single Phase Non-Simultaneous Dual Element Control Mode with 3 Wire Outlet Operation As schematically depicted in FIG. 8, to provide this dual element operational control mode, single phase power supply conductors 110 and 112 are respectively connected to the terminal block line side terminals $L_C$ and $L_D$. On the water heater side 46*b* of the terminal block 46, terminals $H_A$ and $H_B$ are connected such as with additional wiring or a jumper. If off peak metering is desired, an off peak meter or timer is connected to terminal $L_E$.

Three Phase Simultaneous Dual Element Control Mode

Figure 9:
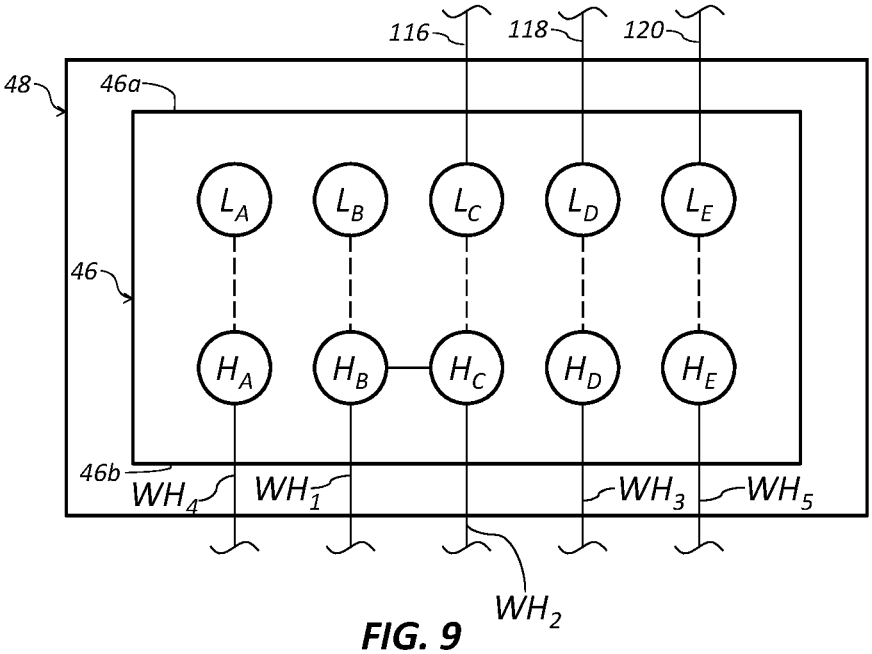
FIG. 9 is a schematic diagram of a junction box/terminal block structure operatively associated with the heating element control thermostats of the water heater for a three phase simultaneous dual element control mode.

As schematically depicted in FIG. 9, to provide this dual element operational control mode, three phase power supply conductors 116, 118, and 120 are respectively connected to the terminal block line side terminals $L_C$, $L_D$, and $L_E$. On the water heater side 46*b* of the terminal block 46, terminals $H_B$ and $H_C$ are connected such as with additional wiring or a jumper.

Three Phase Non-Simultaneous Dual Element Control Mode

Figure 10:
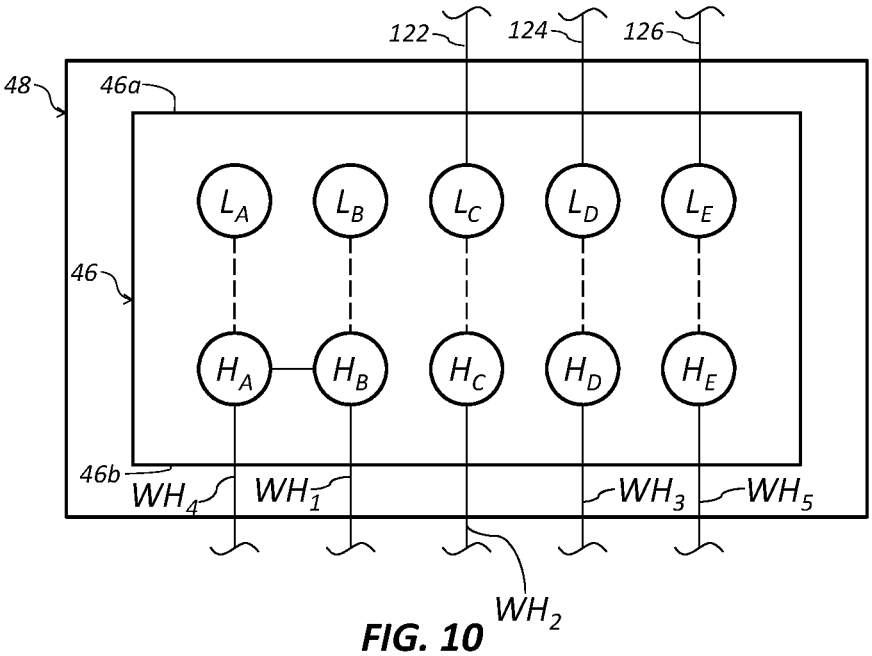
FIG. 10 is a schematic diagram of a junction box/terminal block structure operatively associated with the heating element control thermostats of the water heater for a three phase non-simultaneous dual element control mode.

As schematically depicted in FIG. 10, to provide this dual element operational control mode, three phase power supply conductors 122, 124, and 126 are respectively connected to the terminal block line side terminals $L_C$, $L_D$, and $L_E$. On the water heater side 46*b* of the terminal block 46, terminals $H_A$ and $H_B$ are connected such as with additional wiring or a jumper.

As can readily be seen from the foregoing, the water heater 10 may uniquely be field-converted selectively among its seven representative dual heating element operational control modes simply by appropriately altering the electrical connections in the terminal block 46. In contrast to conventionally constructed dual element electric water heaters, there is simply no need to either (1) replace either of the upper and lower thermostats 38 and 40 with another type of thermostat, or (2) change the wiring connections to the two thermostats or from the thermostats to the terminal block. This advantageously makes the representatively listed seven dual heating element operational control modes available with the single illustrated variant of the dual element electric water heater 10. In addition, as can readily be seen from the foregoing preferred embodiments, the connections of terminals in the terminal block 46 are to adjacent terminals and can be made using connections such as additional wiring or a jumper of a uniform size. While the present invention has been illustratively incorporated in an electric water heater, it will be readily appreciated that principles of the invention could also be incorporated in dual element liquid heating devices of other types if desired. It will additionally be appreciated that while the terminals $H_A$, $H_B$, $H_C$, $H_D$, and $H_E$ are representatively connectable in selectively variable manners using jumpers or other similar connectors to a terminal block portion of a junction box, the outer ends of the wiring harness conductors $WH_1$, $WH_2$, $WH_3$, $WH_4$, and $WH_5$ could alternatively be variably connected to an external electrical power source in a variety of other manners, including, for example, the use of connections between $L_A$, $L_B$, $L_C$, $L_D$, and $L_E$, if desired.

The foregoing detailed description is to be clearly understood as being given by way of illustration and example, the spirit and scope of the present invention being limited solely by the appended claims.

What is claimed is:

1. A liquid heating apparatus comprising:

a tank adapted to hold a quantity of liquid to be heated;

first and second spaced apart electric heating elements extending into an interior of the tank and being operable to heat liquid therein;

first and second electric thermostats respectively and controllingly associated with the first and second electric heating elements;

a junction box having a terminal block with line side terminals to which electrical power supply conductors are variably connectable, and a heating apparatus side with heating side terminals; and wiring operatively connected to the first and second electric thermostats and having portions connectable to the heating side terminals in a fixed arrangement, wherein the wiring is connected to the first and second electric thermostats and the heating side terminals in a manner such that, without replacing either of the first and second thermostats or altering the wiring to either of the first and second thermostats or the heating side terminals, a selective portion of the electrical power supply conductors is connected to the line side terminals to provide the liquid heating apparatus with a plurality of heating element control modes, the plurality of heating element control modes including:

(1) a dual independent branch circuit element control mode, (2) a single phase simultaneous dual element control mode, (3) a single phase non-simultaneous dual element control mode, (4) a single phase non-simultaneous dual element control mode with four wire outlet operation, (5) a single phase non-simultaneous dual element control mode with three wire outlet operation, (6) a three phase simultaneous dual element control mode, and (7) a three phase non-simultaneous dual element control mode.

2. The liquid heating apparatus of claim 1, wherein the first and second electric heating elements are vertically spaced apart electric resistance type heating elements with the first electric heating element being disposed higher than the second electric heating element.

3. The liquid heating apparatus of claim 2, wherein:

the first electric thermostat is a single pole double throw thermostat, and the second electric thermostat is a single pole single throw thermostat.

4. The liquid heating apparatus of claim 1, wherein the plurality of heating element control modes includes simultaneous operation of the first and second electric heating elements and non-simultaneous operation of the first and second electric heating elements.

5. The liquid heating apparatus of claim 1, wherein the plurality of heating element control modes includes thermostatically controlled simultaneous energization of the first and second electric heating elements and thermostatically controlled sequential energization of the first and second electric heating elements.

6. The liquid heating apparatus of claim 1, further comprising one or more jumpers variably connectable to the line side terminals or to the heating side terminals to enable each of the plurality of heating element control modes.

7. The liquid heating apparatus of claim 6, wherein each of the one or more jumpers is of a uniform size.

8. An electric water heater comprising:

a tank adapted to hold a quantity of water to be heated;

an upper electric resistance type heating element horizontally extending into an interior of the tank;

a lower electric resistance type heating element horizontally extending into the interior of the tank;

a first electric thermostat controllingly associated with the upper electric resistance type heating element, the first electric thermostat being a single pole double throw thermostat;

a second electric thermostat controllingly associated with the lower electric resistance type heating element, the second electric thermostat being a single pole single throw thermostat; and a wiring harness operatively connected to the first and second electric thermostats and having conductor portions connectable to a first side of a terminal block in a fixed arrangement, the wiring harness being connected to the first and second electric thermostats and to the first side of the terminal block in a manner such that, without replacing either of the first and second electric thermostats or altering wiring connections to either of the first and second electric thermostats or to the first side of the terminal block, a plurality of power supply conductors is connected to a second side of the terminal block to provide the electric water heater with a plurality of heating element control modes, the plurality of heating element control modes including:

(1) a dual independent branch circuit element control mode, (2) a single phase simultaneous dual element control mode, (3) a single phase non-simultaneous dual element control mode, (4) a single phase non-simultaneous dual element control mode with four wire outlet operation, (5) a single phase non-simultaneous dual element control mode with three wire outlet operation, (6) a three phase simultaneous dual element control mode, and (7) a three phase non-simultaneous dual element control mode.

9. The electric water heater of claim 8, wherein the plurality of heating element control modes includes simultaneous operation of the upper and lower electric resistance heating elements and non-simultaneous operation of the upper and lower electric resistance heating elements.

10. The electric water heater of claim 8, wherein the plurality of heating element control modes includes thermostatically controlled simultaneous energization of the upper and lower electric resistance heating elements and thermostatically controlled sequential energization of the upper and lower electric resistance heating elements.

11. The electric water heater of claim 8, further comprising one or more jumpers variably connectable to the terminal block to enable each of the plurality of heating control modes.

12. The electric water heater of claim 11, wherein each of the one or more jumpers is of a uniform size.

13. An electric water heater comprising:

a tank adapted to hold a quantity of water to be heated;

an upper electric resistance type heating element horizontally extending into an interior of the tank;

a lower electric resistance type heating element horizontally extending into the interior of the tank;

a first electric thermostat controllingly associated with the upper electric resistance type heating element, the first electric thermostat being a single pole double throw thermostat;

a second electric thermostat controllingly associated with the lower electric resistance type heating element, the second electric thermostat being a single pole single throw thermostat a terminal block having line side terminals and heating side terminals; and a wiring harness operatively connected to the first and second electric thermostats and having a series of electrical conductors connectable to the heating side terminals in a fixed arrangement, the wiring harness being connected to the first and second thermostats and to the heating side terminals of the terminal block in a manner such that, without replacing either of the first and second electric thermostats and/or altering wiring connections to either of the first and second electric thermostats or to the heating side terminals of the terminal block, a plurality of power supply conductors is connected to the line side terminals to provide the electric water heater with a plurality of heating element control modes, the first electric thermostat having a first ECO portion with first, second, third and fourth power supply terminals, and a first switch portion with a switch power terminal and first and second switch contacts, the second electric thermostat having a second ECO portion with first, second, third and fourth power supply terminals, a second switch portion with a switch power terminal and a switch contact, and the wiring harness including:

(1) a first conductor interconnected between the third power supply terminal of the first ECO portion and the switch power terminal of the first switch portion, (2) a second conductor interconnected between the first switch contact of the first switch portion and the upper heating element, (3) a third conductor interconnected between the fourth power supply terminal of the first ECO portion and the upper heating element, (4) a fourth conductor interconnected between the third power supply terminal of the second ECO portion and the switch power terminal of the second switch portion, (5) a fifth conductor interconnected between the switch contact of the second switch portion and the lower heating element, (6) a sixth conductor interconnected between the fourth power supply terminal of the second ECO portion and the lower heating element, and (7) the series of electrical conductors each having a first end portion operatively connected to one of the first and second thermostats, and a second end portion connectable to the heating side terminals of the terminal block.

14. The electric water heater of claim 13, wherein the series of electrical conductors include:

(1) a first conductor connected at the first end portion to the first power supply terminal of the second ECO portion and connected at the second end portion to one of the heating side terminals, (2) a second conductor connected at the first end portion to the first power supply terminal of the first ECO portion and connected at the second end portion to one of the heating side terminals, (3) a third conductor connected at the first end portion to the second power supply terminal of the first ECO portion and connected at the second end portion to one of the heating side terminals, (4) a fourth conductor connected at the first end portion to the second switch contact of the first switch portion and connected at the second end portion to one of the heating side terminals, and (5) a fifth conductor connected at the first end portion to the second power supply terminal of the second ECO portion and connected at the second end portion to one of the heating side terminals.

15. The electric water heater of claim 14, further comprising one or more jumpers variably connectable to the line side terminals or to the heating side terminals to enable each of the plurality of heating element control modes.

16. The electric water heater of claim 15, wherein each of the one or more jumpers is of a uniform size.

17. The electric water heater of claim 13, wherein the terminal block is incorporated in a junction box removably securable to the electric water heater.

18. The electric water heater of claim 17, wherein the electric water heater has an external well area in which the second end portions of the series of wiring harness conductors are disposed prior to their operative connection to the terminal block.

* * * * *